US005180081A

United States Patent [19]

McCann

[11] Patent Number: 5,180,081

[45] Date of Patent: Jan. 19, 1993

[54] POURING SPOUT AND CARBONATION RETENTION APPARATUS

[75] Inventor: Gerald P. McCann, Los Angeles, Calif.

[73] Assignee: McCann's Engineering & Mfg. Co., Los Angeles, Calif.

[21] Appl. No.: 654,929

[22] Filed: Feb. 14, 1991

Related U.S. Application Data

[63] Continuation-in-part of Ser. No. 473,115, Jan. 31, 1990, abandoned, which is a continuation of Ser. No. 95,362, Sep. 10, 1987, abandoned.

[51] Int. Cl.[5] ..... B65D 83/00

[52] U.S. Cl. ..... 222/23; 222/396; 222/399; 222/400.7

[58] Field of Search ..... 222/396, 397, 399, 400.5, 222/400.7, 23

[56] References Cited

U.S. PATENT DOCUMENTS

| | | | |
|---|---|---|---|
| 706,423 | 8/1902 | Kleinfeldt | 222/399 |
| 1,884,350 | 10/1932 | Stoops | 222/400.7 X |
| 2,017,664 | 10/1935 | Leins | 222/399 |
| 2,051,981 | 8/1936 | Bowman | 222/399 |
| 2,143,565 | 1/1939 | Minea | 137/170.1 X |
| 2,367,077 | 1/1945 | Ward | 222/399 |
| 2,388,026 | 10/1945 | Ward | 222/396 X |
| 2,774,521 | 12/1956 | Creighton | 222/399 |
| 2,842,293 | 7/1958 | Knapp et al. | 222/399 |
| 3,272,404 | 9/1966 | Graves et al. | 222/396 |
| 3,315,844 | 4/1967 | Klasson et al. | 222/399 X |
| 3,434,632 | 3/1969 | Batrow | 222/400.5 |
| 3,502,111 | 3/1970 | Hansen | 137/170.1 X |
| 4,462,424 | 7/1984 | Genbauffe et al. | 222/399 X |
| 4,934,543 | 6/1990 | Schmidt | 222/399 X |
| 5,022,565 | 6/1991 | Sturman et al. | 222/399 X |
| 5,972,292 | 1/1898 | Linder et al. | 222/399 X |

*Primary Examiner*—Andres Kashnikow
*Assistant Examiner*—Anthoula Pomrening
*Attorney, Agent, or Firm*—Lyon & Lyon

[57] ABSTRACT

A pouring spout and carbonation retention apparatus for selectively dispensing a variable or fixed portion of gas-containing liquid from a container is disclosed. The apparatus includes a housing wherein the housing is adapted to be attached to the container. The container houses a liquid, normally a carbonated liquid, such a cola or root beer. A removable vessel is included for maintaining a charge of gas and is mounted within the housing. a spout of the type conventionally used for the dispensing of liquids is integral with the housing and extends outwardly therefrom, and a handle is pivotably attached to the top of the housing to be movable with respect to the housing. A series of channels are located between the vessel, which contains the charge of gas, and the container. Movement of the handle will cause a variable or fixed charge of gas to enter the container for dispersion into the liquid in the container. A second series of channels are located in the housing and serve as a path for transporting the variable or fixed portion of gas-containing liquid from the container to the spout in response to movement of the handle. These channels operate to reduce foam in the liquid being dispensed.

28 Claims, 2 Drawing Sheets

POURING SPOUT AND CARBONATION RETENTION APPARATUS

This application is a continuation-in-part of copending application Ser. No. 473,115 filed on Jan. 31, 1990, now abandoned which in turn is a continuation of application Ser. No. 095,362 filed on Sep. 10, 1987, now abandoned.

BACKGROUND OF THE INVENTION

The field of the present invention, in general, relates to liquid dispensing apparatus and in particular relates to an apparatus which includes a pouring spout and carbonation retention capability wherein an operator can by movement of a lever introduce a variable or fixed amount of gas into a liquid which is then dispensed in a variable or fixed portion.

There was a time in the beverage industry when beverages were stored in eight or twelve ounce bottles and then capped with metal caps for sale to the customer. In these instances, the customer would open the bottle and dispense either all or a portion of the beverage, usually a soft drink, from the bottle. Cap designs for these bottles were extremely limited, and once the cap had been removed it was impractical or impossible to recap the bottle and thus maintain the partial-pressure of the gas in the gas-containing liquid, which is typically a carbonated liquid such as a soft drink. Further developments were made in terms of providing caps for these open bottles. A cap was designed which would replace the original cap on the bottle and would serve the purpose of maintaining the partial pressure of the gas in the carbonated liquid. However, it is known that when using these cap designs, the partial pressure of the gas within the carbonated liquid would eventually decrease and the soft drink would become "flat".

Because of the popularity of soft drinks, manufacturers have commonly sought to design and implement larger containers to store more of the soft drink. These larger containers have certain advantages and numerous disadvantages. For example, a common advantage of these containers is that more liquid can be packaged in one container thereby reducing the cost of the container and also reducing the cost of manufacturing the container. Moreover, due to environmental considerations it is desirable to have fewer but larger containers, i.e. less possibility for litter.

However, as mentioned previously, there are some severe disadvantages associated with the use of large containers. One of the primary disadvantages of a large container is that once the large container is opened, the partial pressure of the gas, normally carbon dioxide, in the liquid is reduced to a level where the carbonated liquid becomes "flat". Again, various cap designs have been developed for the purpose of retaining the carbonation in the liquid. However, these cap designs suffer from the same drawbacks as prior cap designs and eventually the carbonated liquid becomes "flat".

There have also been attempts to design equipment useful for recarbonating liquids, wherein an impeller type device is designed to be inserted into the container to stir a liquid while simultaneously introducing gas into the liquid for the purpose of recarbonating the liquid. However, due to the expense of these apparatus they have not yet achieved any commercial significance.

With the increasing cost of carbonated liquids, such as soft drinks, it is desirable to provide a system for maintaining the carbonation of the soft drink for use over extended periods of time. In this manner, substantially less waste occurs and the carbonated liquid or soft drink maintains its fresh and acceptable taste for a longer period of time.

OBJECTS OF THE INVENTION

Therefore, it is an object of the present invention to provide a pouring spout and carbonation retention apparatus which is useful to simultaneously facilitate pouring of a liquid and carbonation or recarbonation of that liquid.

It is another object of the present invention to provide a easily mountable pouring spout and carbonation retention apparatus for use with conventional sized liquid containers, normally two liter containers, for the purpose of dispensing a carbonated liquid from the container and maintaining the partial pressure of the gas in the liquid.

It is another object of the present invention to provide a manually operable pouring spout and carbonation retention apparatus which is easily mounted upon standard size containers for dispensing variable or fixed portions of carbonated liquids from the containers and which can be reused and remounted for use with a wide variety of carbonated liquid containers.

It is another object of the present invention to provide a pouring spout and carbonation retention apparatus which will introduce a preselected amount of gas into a liquid which is then dispensed in variable or fixed portions.

It is another object of the present invention to provide a pouring spout and carbonation retention apparatus which is adapted to receive and hold a vessel containing a charge of gas for introduction of a portion of the gas into a liquid which is then dispensed.

It is another object of the present invention to provide a pouring spout and carbonation retention apparatus which includes an indicator to advise the operator of the level of carbonation in the liquid or the amount of gas remaining in a vessel included in the apparatus, which is provided to maintain the partial pressure of gas in the liquid.

It is another object of the present invention to provide a pouring spout and carbonation retention apparatus which includes a system for reducing the amount of foam resulting from the operation of dispensing carbonated liquids.

It is another object of the present invention to provide a pouring spout and carbonation retention apparatus which has a blow-out valve included for safe operation of the apparatus.

SUMMARY OF THE INVENTION

The pouring spout and carbonation retention apparatus of the present invention includes, in summary, a housing wherein the housing is adapted to be attached to a container which includes a liquid. A typical container may be of the 1, 2 or 3 liter type used for storing soft drinks such as root beers or colas. A removable vessel is included in the housing and contains a charge of gas. Normally, the gas in the vessel is carbon dioxide which is used in the carbonating and dispensing of soft drinks. A spout is attached to the housing and is designed to permit easy pouring of the carbonated liquid from the container. The spout is open to the container through a series of passageways which are operative to reduce the foaming of the carbonated liquid prior to its dispensing from the spout.

A handle is typically attached to the housing and extends outwardly therefrom for actuation by an operator. A vessel is contained within the housing and is interconnected to the container through a series of channels. In one of the channels, a valve is located which has an indicator assembly operative therewith to advise the operator of the pressure of gas within the vessel. In another of the channels, a blow-out valve is included to prevent the gas in the vessel from expanding fully into the container.

A reciprocal moving piston is included in another channel and is movable in response to actuation of the handle, which occasions movement of a rod located in the housing which, in turn, causes movement of the piston. Actuation of the handle will cause movement of the piston to permit a variable or fixed amount of gas (depending upon the design) to enter the container thereby forcing gas into the liquid and providing motive gas for dispensing of the liquid through the spout. A fixed or variable portion of gas-containing liquid may then be dispensed. A coil is included in the housing and lies between the container and the spout to reduce the foaming of the carbonated liquid, which in some instances, such as root beer, can be quite excessive.

The foregoing and additional objects and features of the invention will become apparent from the following description in which the preferred embodiments have been set forth in detail in conjunction with the accompanying drawings.

FIG. *2a* is a detailed view of the piston and stem combination in the pouring spout and carbonation retention apparatus of the present invention.

Figure 3:
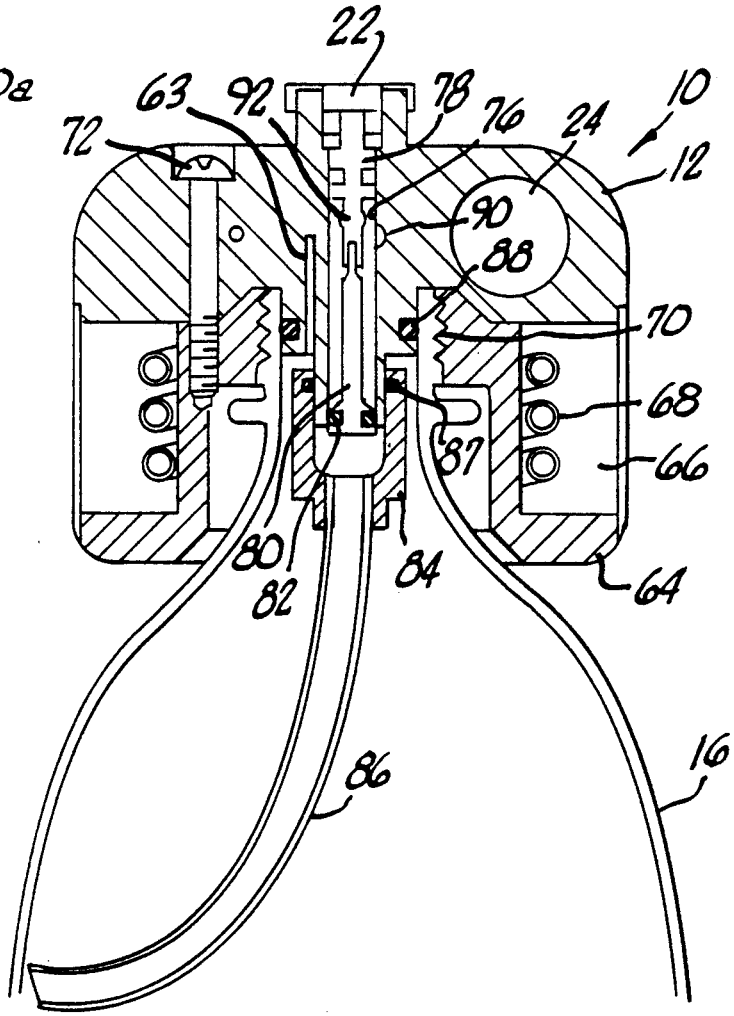

FIG. 3 a side cross-sectional view of the pouring spout and carbonation retention apparatus of the present invention mounted upon a container.

DETAILED DESCRIPTION OF THE PREFERRED EMBODIMENTS

Figure 1:
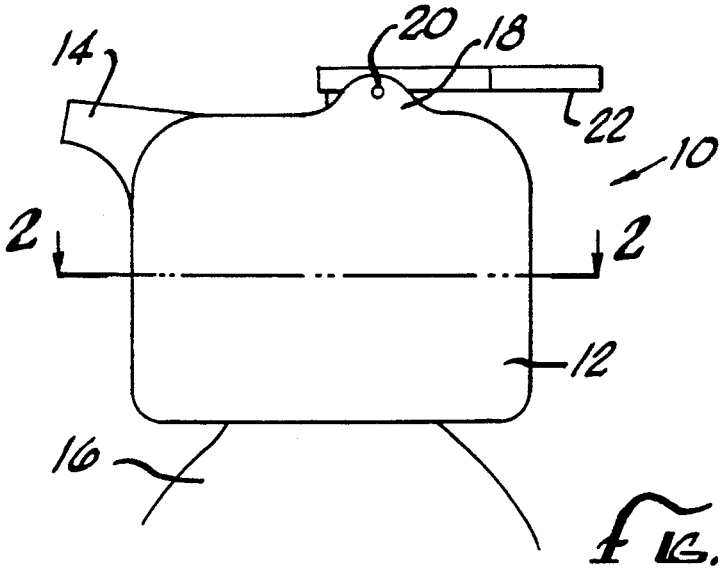
FIG. 1 is a side perspective view of the pouring spout and carbonation retention apparatus of the present invention.

A general perspective view of the pouring spout and carbonation retention apparatus made in accordance with the present invention is illustrated in FIG. 1. The apparatus 10 includes a housing 12 which has at one end thereof a spout 14 integral therewith for dispensing liquid from a container 16. The housing 12 is adapted to fit on top of the container 16 wherein the upwardly extending neck portion of the container 16 is received into the lower portion of the housing 12. As will be discussed in greater detail later, the housing 12 may be threaded to receive the neck or it may be provided with an o-ring to press-fit the housing 12 onto the neck and container 16. Other configurations of the housing 12 are possible to receive container necks of varying sizes and shapes. The housing 12 includes upwardly extending flaps 18 in parallel alignment which have an axially bored pivot point 20 and pin (not shown). The pin (not shown) is attached to a handle 22 which extends outside of the diameter of the housing 12. The handle 22 is generally pivotable in a counter-clockwise direction about the pivot point 20. The handle 22 may take on various configurations and sizes to ergonomically fit the desired application.

Figure 2:
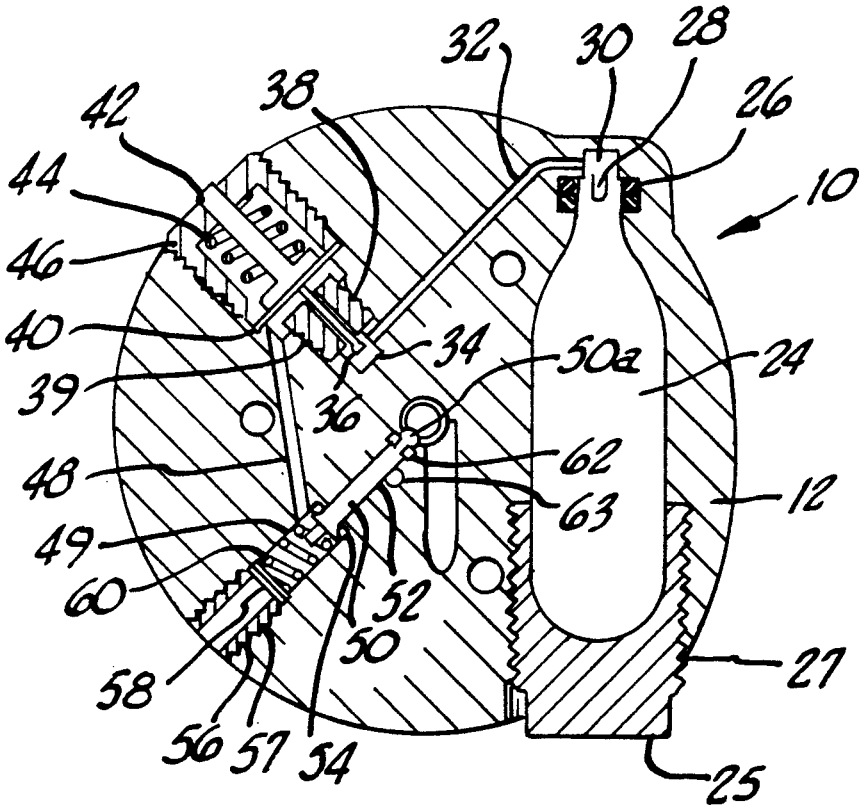
FIG. 2 is a top cross-sectional view of the pouring spout and carbonation retention apparatus of the present invention.

A top cross-sectional view, substantially along the line 2—2 of FIG. 1, of the pouring spout and carbonation retention apparatus of the present invention is shown in FIG. 2. Within the housing 12 a removable vessel 24 is located which contains a gas, normally carbon dioxide, for use in carbonating soft drinks or the like. The vessel 24, more commonly known as a cartridge, is commonly available in beverage stores or similar retail locations. The vessel 24 fits within an opening in the housing 12 and is maintained within the housing 12 by a plug 25 which has a series of threads 27 engageable with opposing threads machined in the housing 12. The inside surface of the plug 25 is shaped s that the vessel 24 fits snugly within the housing 12.

A plurality of o-rings 26 are located within the housing 12 substantially at the uppermost portion of the opening in the housing 12 in which the vessel 24 is positioned. The o-rings 26 are sized to permit the neck of the vessel 24 to fit in a tight and sealed relationship with the housing 12, whereby the o-rings 26 provide an effective seal to prevent leakage of gas from the vessel 24. A pin 28 is located at the uppermost portion of the opening which houses the vessel 24 and is operative to pierce the vessel 24 to permit gas to flow from the vessel 24 into a chamber 30. Rotation of the plug 25 will mechanically force the pin 28 to pierce the top of the vessel 24 and release the gas contained therein.

A first channel 32 extends from the chamber 30 through the housing 12 to a chamber 34. A pilot pin 36 is located partially in the chamber 34 with the shaft of the pilot pin 36 extending through a plug 38 which is engaged with the housing 12 by a plurality of threads 39. The pilot pin 36 has a substantially circular disk 40 attached at the end opposite the portion which extends into the chamber 34. The disk 40 supports a plunger 42 which has located thereabout a spring 44. The spring 44, plunger 42, and platform 40 are sized to permit limited movement with respect to the inner portion of the plug 46.

The pin 42 is reciprocal within the plug 46 such that as the pressure in the vessel 24 decreases, the spring 44 will apply a force to the pin 42 to move the pin 42 further into the plug 46. By the position of the pin 42 (or a suitable indicator means attached thereto), the operator is advised of the pressure in the vessel 24.

A second channel 48 extends from the opening located beneath the platform 40 and extends to a chamber 49 again located within the housing 12. A reciprocating piston 50 is located partially within the chamber 49 and is also within a channel 52. An o-ring 54 is provided at an upward most portion of the piston 50 to seal the channel 52 which receives the piston 50.

A plug 56 is engaged with the housing 12 by a series of threads 57. The plug 56 includes a blow-out disk 58 which is located at one portion of the plug 56 and supports a spring 60 which applies a force to the piston 50 to maintain the piston 50 within the channel 52. In the preferred embodiments the blow-out disk 58 is calibrated to withstand 100 to 150 pounds of pressure per square inch. In this manner the blow-out disk 58 and plug 56 operate as a pressure relief valve to prevent excess gas pressure in the vessel 24 from entering the container 16.

The piston 50 has a second o-ring 62 located at its end opposite the end which extends into the channel 49 and operates to seal the channel 52. Another channel 63 is bored into the housing 12 and provides a passageway from the channels 32 and 48 into the container 16. The channel 63 is more clearly illustrated in FIG. 3.

In FIG. 3 the pouring spout and carbonation retention apparatus of the present invention is shown in a vertical cross section. The housing 12 includes a substantially annular portion 64 which extends downwardly from the main body of the housing 12. Within the annular portion 64 is an opening 66 in which a series of coils 68 are present. The coils 68 are preferably tubings formed in a spiral or coiled shape out of polyethylene material of approximately ⅛ inch in diameter and suitable wall thickness.

The housing 12 is matingly engaged with the container 16 by a series of threads 70 to permit secured attachment of the housing 12 to the container 16. Appropriate sealing parts 88 in the form of o-rings may be located between the housing 12 and the container 16. A set screw 72 or plurality thereof are adapted to attach the housing 12 to the annular portion 64. A channel 76 is cut substantially in the center of the housing 12 and extends entirely through the housing 12. In the channel 76 is a pin 78, which at its upper most portion engages the lower portion of the handle 22.

In the preferred embodiment the pin 78 is affixed to the lower portion of the handle 22, however, it is known that a spring (not shown) may be disposed within the channel 76 to apply an upwardly extending force upon the pin 78 to maintain the upper portion of the pin 78 in contact with the lower portion of the handle 22. The pin 78 is attached to a piston 80, which is adapted to seal the channel 76 from the inner portion of the container 16 by the use of an o-ring 82.

A fitting 84 is attached to the housing 12 and has extending outwardly therefrom a tube 86 which extends into the inner portion of the container 16 and is adapted to transport liquid from the container 16 for dispensing by the apparatus 10. Again, appropriate sealing parts 87 in the form of o-rings are located between the housing 12 and the fitting 84. A channel 90, only a portion of which is shown in FIG. 3, extends from the channel 76 to the coils 68.

The operation of the pouring spout and carbonation retention apparatus of the present invention will now be described. By rotation of the handle 22, the pin 78 moves downward in the channel 76 until the bump 92 located along the body of the pin 78 strikes the piston 50 at the point 50*a* which extends into the channel 76. Movement of the piston 50 upon engagement of the point 50*a* with the bump 92 will unseat the o-ring 54, opening up the channel 52 to the channel 48.

When the o-ring 54 is unseated, gas contained within the vessel 24 passes through the chamber 30 into the channel 32 and into the chamber 34. The ga then passes around the pin 36 and into the channel included in the plug 38. From the channel included in the plug 38 the gas passes into the channel 48 and when the piston 50 is moved to unseat the o-ring 54 the gas passes then into the channel 52 and then into the channel 63. Once in the channel 63, the gas then passes into the container 16 to increase pressure for the dispensing of the carbonated liquid stored within the container 16. The apparatus 10 may be constructed so that either a fixed or variable portion of gas is introduced into the container 16.

Figure 2A:
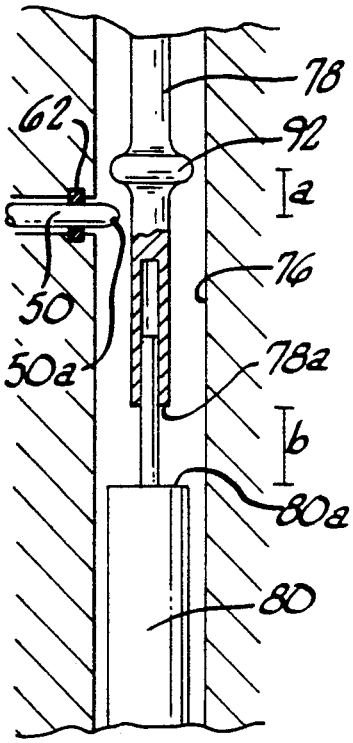

In the preferred embodiment, a discrete charge of gas is injected. Referring to FIG. 2*a*, as the handle 22 is actuated, the pin 78 moves downward. When the bump 92 contacts the point 50*a* on the piston 50, gas from the vessel 24 is directed into the container 16. The bump 92 and the point 50*a* are both rounded surfaces, and the o-ring 54 is unseated only when the bump 92 and the point 50*a* are fully aligned. The bump 92 and the point 50*a* are over-centered such that alignment may only occur momentarily as the pin 78 makes it downward (or upward) stroke. Since dimension a is less than dimension b, it is only after the bump 92 has passed the point 50*a* (and the o-ring 54 is reseated) that the bottom 78*a* of the pin 78 contacts the shoulder 80*a* of the piston 80. As the pin 78 continues to move downward, it then displaces the piston 80, unseating the o-ring 82 and allowing the carbonated liquid in the container 16 to pass through the tube 86 into the fitting 84 and around the o-ring 82 into the channel 76.

The dispenser 10 includes a liquid channel means for transporting gas-containing liquid from the container 16 to the spout 14 in response to movement of the handle 22. The liquid channel means includes channel 76, channel 90 and coiled tubing 68.

From the channel 76, the carbonated liquid passes into the channel 90 and into the coils 68 and up to the spout 14 to be dispensed. The number of coils 68 located within the apparatus 10 is variable depending upon the amount of foam reduction required or desired. As the gas-containing liquid travels through the coils 68, foaming action is reduced. The coils 68 are wound so as to minimize sharp corners which would tend to increase foaming.

The handle 22 therefore travels between three distinct functional positions: (1) a first "off" position in which neither o-ring 82 or o-ring 54 is unseated, (2) a second "on" position at which only the o-ring 82 is unseated dispensing liquid, and (3) a third position between the first and second positions at which only the o-ring 54 is unseated introducing gas.

Liquid may be dispensed for as long as the handle is fully depressed (position 2), but only as long as the discrete charge holds out. Since only a discrete charge of gas has previously been introduced into the container 16 during the downward stroke, once the charge of gas is dissipated, there will be insufficient charge gas in the container 16 to expel liquid and the flow of liquid will cease with the result that only a predetermined amount, that is a discrete volume, of liquid will be dispensed. If the user desires to expel additional liquid, the user would have to release the handle 22 and then depress it again introducing another discrete charge of gas into the container 16 and then fully actuate the handle 22 to dispense liquid. If desired, the user may "pump" the device (that is, consecutively actuating the handle 22 up and down passing position 3) to introduce a number of gas charges to achieve a desired total charge, a gas charge being introduced as position 3 is passed whether on the upward or downward stroke.

For as long as the discrete gas charge(s) hold out, the operator may dispense liquid for as long as the handle is depressed. As such, the operator may dispense a variable amount of liquid, that is a desired amount.

The amount of discrete charge may depend in part upon the speed which the handle 22 is depressed, but in the preferred embodiment, the over-centering alignment of the bump 92 and the point 50*a* is intended to allow only momentary alignment and prevent a user from introducing a continuous charge of gas. The shape and size of the bump 92 and the point 50*a* may be designed to permit a greater or smaller momentary alignment as desired. Alternately, the shape and size of the bump 92 and the point 50*a* may be designed to permit the user such that the speed of actuation may have greater or lesser impact on the amount of discrete charge such as by greater or lesser over-centering geometry.

Alternately, an adjustment means may be included which would permit an adjustment of the amount of discrete charge of gas. One method would be to permit adjustment of the momentary alignment mechanism of the bump 92 and the point 50*a* such as by providing an adjustment means for the stiffness of the pin 78.

The housing 12 is normally made of polycarbonate or ABS plastic. However, it is well known that other inert materials may be used for these purposes. Normally, the o-rings are made of rubber and the internal working parts are made of either plastic or stainless steel.

It should be understood that although the present invention contemplates the use of an indicator mechanism and a blow-out valve, it is possible to construct the present invention without either of those components. Also, alternative actuator assemblies may be used other than the lever type handle (i.e. the actuation means) illustrated—for example, a push-button switch or rotating handle may be used.

While the foregoing embodiments are at present considered to be preferred, it is understood that numerous variations and modifications may be made therein by those skilled in the art, and it is intended to cover in the appending claims all such variations and modifications as fall within the true spirit and scope of the invention.

What is claimed is:

1. A liquid dispensing apparatus for selectively dispensing a portion of liquid from a container, comprising;

a housing, said housing adapted to be attached to the container;

a vessel for storing and supplying a charge of gas, said vessel contained within said housing;

a spout attached to said housing;

gas channel means for providing fluid communication between said vessel and said container;

piston means for releasing a charge of gas from said vessel through said gas channel means and into said container;

a handle means operably connected tot he piston means and movable with respect to said housing and attached thereto for actuating between an off first position and a dispensing second position;

liquid channel means for transporting the portion of liquid from the container to said spout in response to movement of said handle means; and means for reducing foam occasioned by passage of the portion of liquid from said spout, wherein said means for reducing foam includes a coiled section of tubing in said liquid channel means through which liquid flows, wherein movement of said handle means into the dispensing second position is operative to dispense liquid from said spout.

2. A liquid dispensing apparatus according to claim 1 further including a safety valve means in communication with said gas channel means for preventing excess gas pressure from entering said container.

3. A liquid dispensing apparatus according to claim 1 further including a means for indicating pressure in said vessel.

4. A liquid dispensing apparatus according to claim 1 in which said vessel is removable from said housing.

5. A liquid dispensing apparatus according to claim 1 which further includes means for affixing said housing to the container.

6. A liquid dispensing apparatus according to claim 1 further comprising a liquid holding container to which the dispensing apparatus is mounted.

7. A liquid dispensing apparatus for selectively dispensing a portion of liquid from a container, comprising;

a housing, said housing adapted to be attached to the container;

a vessel for storing and supplying a charge of gas, said vessel contained within said housing;

a spout attached to said housing;

gas channel means for providing fluid communication between said vessel and said container;

piston means for releasing a charge of gas from said vessel through said gas channel means and into said container;

a handle means operably connected to the piston means and movable with respect to said housing and attached thereto for actuating between an off first position and a dispensing second position;

liquid channel means for transporting the portion of liquid from the container to said spout in response to movement of said handle means;

wherein movement of said handle means into the dispensing second position is operative to dispense liquid from said spout, wherein gas is not released from said vessel into said container when said handle means is in said second dispensing position.

8. A liquid dispensing apparatus for selectively dispensing a portion of gas-containing liquid from a container, comprising;

a housing, said housing adapted to be attached to the container;

a removeable vessel for maintaining a charge of gas, said vessel contained within said housing, said vessel maintained in said housing by a plug;

a spout attached to said housing;

gas channel means for providing fluid communication between said vessel and said container;

piston means for releasing a charge of gas from said vessel through said gas channel means and into said container;

actuation means operably connected to the piston means for actuating the dispensing of liquid, said actuating means manually operable by the operator between an off first position and a dispensing second position;

means for introducing a discrete charge of gas from said vessel into said container in response to operation of said actuation means passing to the second position;

means for transporting the portion of gas-containing liquid from the container to said spout in response to movement of said actuating means;

safety valve means for preventing excess pressure from entering the container;

indicator means for sensing the level of pressure in said vessel;

means for reducing foam occasioned by dispensing of the gas-containing liquid;

wherein movement of said actuation means into the dispensing second position is operative to dispense a portion of gas-containing liquid from said spout.

9. A liquid dispensing apparatus according to claim 8 further including means for affixing said housing to the container.

10. A liquid dispensing apparatus for selectively dispensing a portion of gas-containing liquid from a container, comprising;

a housing, said housing adapted to be attached to the container;

a vessel for storing and supplying a charge of gas, said vessel contained within said housing;

a spout attached to said housing;

gas channel means for providing fluid communication between said vessel and said container;

first valve means in said gas channel means for selectively releasing a charge of gas from said vessel through said gas channel means and into said container;

liquid channel means for providing fluid communication for the portion of gas-containing liquid from the container to said spout;

second valve means in said liquid channel means for selectively opening passage between said container through said liquid channel means and to said spout; and actuation means for actuating said first and second valve means, said actuation means including: (a) a handle means movable with respect to said housing and attached thereto, and (b) a pin means which is axially translated by movement of said handle means, said pin means having (a) a protrusion on its side which engages a portion of said first valve means during axial translation of said pin means thereby opening said first valve means when engaged and (b) a connection to said second valve means which opens said second valve means during axial translation of said pin means.

11. A liquid dispensing apparatus according to claim 10 further comprising a liquid holding container to which the dispensing apparatus is mounted.

12. A liquid dispensing apparatus for dispensing liquid from a container, comprising;

a housing, said housing adapted to be attached to the container;

a spout attached to said housing;

a vessel for storing and supplying a charge of gas, said vessel mounted on said housing;

passage means for providing fluid communication between said vessel and said container;

fluid channel means for providing fluid communication from the container to the spout;

means for releasing a charge of gas from said vessel and into said container;

means for dispensing liquid from said container out the spout;

actuator means mounted to said housing and movable with respect thereto for actuating said means for releasing and said means for dispensing; and means for ensuring that only a discrete, noncontinuous charge of gas is released in response to operation of said actuator means, wherein operation of said actuator means is operative to dispense liquid from said container out said spout.

13. A liquid dispensing apparatus according to claim 12 wherein operation of said actuator means dispenses a discrete volume of liquid.

14. A liquid dispensing apparatus according to claim 12 wherein operation of said actuator means dispenses a fixed volume of liquid.

15. A liquid dispensing apparatus according to claim 11 further including a means for indicating pressure in said vessel.

16. A liquid dispensing apparatus according to claim 12 in which said vessel is removable from said housing.

17. A liquid dispensing apparatus according to claim 12 which further includes means for affixing said housing to the container.

18. A liquid dispensing apparatus according to claim 12 wherein said actuator means is a lever.

19. A liquid dispensing apparatus for dispensing liquid from a container, comprising:

a housing, said housing adapted to be attached to the container;

a spout attached to said housing;

a vessel for storing and supplying a charge of gas, said vessel mounted on said housing;

passage means for providing fluid communication between said vessel and said container;

fluid channel means for providing fluid communication from the container to the spout;

means for releasing a discrete charge of gas from said vessel and into said container;

means for dispensing liquid from said container out the spout;

actuator means mounted to said housing and movable with respect thereto for actuating said means for releasing and said means for dispensing; and a safety valve means operative with said means for releasing a charge of gas from said vessel into said container in response to movement of said actuator means, wherein operation of said actuator means is operative to dispense liquid from said container out said spout.

20. A liquid dispensing apparatus for dispensing liquid from a container, comprising;

a housing, said housing adapted to be attached to the container;

a spout attached to said housing;

a vessel for storing and supplying a charge of gas, said vessel mounted on said housing;

passage means for providing fluid communication between said vessel and said container;

fluid channel means for providing fluid communication from the container to the spout;

means for releasing a charge of gas from said vessel and into said container;

means for dispensing liquid from said container out the spout;

actuator means mounted to said housing and movable with respect thereto for actuating said means for releasing and said means for dispensing; and means for reducing foam occasioned by passage of liquid from said spout, wherein operation of said actuator means is operative to dispense liquid from said container out said spout.

21. A liquid dispensing apparatus according to claim 20 wherein said means for reducing foam comprises a coiled section of tubing in said fluid channel means through which liquid flows.

22. A liquid dispensing apparatus for selectively dispensing a portion of gas-containing liquid from a container, comprising;

a housing, said housing adapted to be attached to the container;

a removeable vessel for maintaining a charge of gas, said vessel contained within said housing, said vessel maintained in said housing by a plug;

a spout attached to said housing;

means for actuating the dispensing of liquid, said actuating means operable at the will of the operator between an off first position and a dispensing second position;

means for introducing a discrete charge of gas from said vessel into said container in response to said actuating means passing by a third position between the first position and the second position;

means for transporting the portion of gas-containing liquid from the container to said spout in response to movement of said actuating means;

safety valve means for preventing excess pressure from entering the container;

indicator means for sensing the level of pressure in said vessel;

means for reducing foam occasioned by dispensing of the gas-containing liquid;

wherein movement of said actuating means into the dispensing second position is operative to dispense a portion of gas-containing liquid from said spout.

23. A liquid dispensing apparatus according to claim 22 further including means for predetermining the amount of liquid to be dispensed.

24. The liquid dispensing apparatus according to claim 22, wherein said actuating means comprises a handle pivotably attached to said housing and a piston reciprocally movable in response to movement of said handle.

25. The liquid dispensing apparatus according to claim 22 further including mean for affixing said housing to the container.

26. A liquid dispensing apparatus for selectively dispensing a portion of gas-containing liquid from a container, comprising;

a housing, said housing adapted to be attached to the container;

a vessel adapted to be received into said housing, said vessel maintained in said housing by a plug; means for piercing said vessel to release gas contained in said vessel;

a first channel in communication with said vessel when opened by said piercing means;

indicator means for sensing the level of gas pressure in said vessel;

a second channel in communication with said first channel;

safety valve means in communication with said first and second channel for preventing excess pressure from entering said container;

a spout attached to said housing;

a actuator movable with respect to housing and attached thereto;

means operative with said actuator for introducing a discrete charge of gas from said vessel into said container in response to movement of said actuator;

means for transporting the portion of gas-containing liquid from the container to said spout in response to movement of said actuator;

means for reducing foam associated with said gas-containing liquid when being dispensed;

means for rigidly affixing said housing to the container;

wherein movement of said actuator is operative both to introduce a charge of gas from said vessel into the container and to transport the portion of gas-containing liquid from the container to said spout.

27. A liquid dispensing apparatus according to claim 26 wherein the volume of said portion of gas-containing liquid dispensed depends upon the amount of discrete charge of gas introduced.

28. A liquid dispensing apparatus according to claim 26 wherein said actuator means is a lever.

* * * * *

UNITED STATES PATENT AND TRADEMARK OFFICE

CERTIFICATE OF CORRECTION

PATENT NO. : 5,180,081

DATED : January 19, 1993

INVENTOR(S) : Gerald P. McCann

It is certified that error appears in the above-identified patent and that said Letters Patent is hereby corrected as shown below:

In the Abstract, line 9, after "housing.", change "a" to --A--.

In column 7, line 47, after "connected" change "tot he" to --to the--.

In column 10, line 2, change "11" to --12--.

Signed and Sealed this

Fourteenth Day of December, 1993

*Attest:*

Bruce Lehman

BRUCE LEHMAN

*Attesting Officer*

*Commissioner of Patents and Trademarks*